US009142927B2

(12) United States Patent
Tseng

(10) Patent No.: US 9,142,927 B2
(45) Date of Patent: Sep. 22, 2015

(54) ELECTRICAL CONNECTION DEVICE HAVING A STANDARD PLUG AND A REVERSE PLUG AT TWO ENDS OF A CABLE

(71) Applicant: Molex Incorporated, Lisle, IL (US)

(72) Inventor: Ting-Chang Tseng, Taipei (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 14/248,471

(22) Filed: Apr. 9, 2014

(65) Prior Publication Data

US 2014/0302699 A1 Oct. 9, 2014

(30) Foreign Application Priority Data

Apr. 9, 2013 (TW) ..... 102206385 A

(51) Int. Cl.

| | |
|---|---|
| ***H01R 13/627*** | (2006.01) |
| ***H01R 13/625*** | (2006.01) |
| ***H01R 31/06*** | (2006.01) |
| ***H01R 13/645*** | (2006.01) |
| *H01R 12/72* | (2011.01) |
| *H01R 13/64* | (2006.01) |

(52) U.S. Cl.

CPC ..... *H01R 31/06* (2013.01); *H01R 13/6278* (2013.01); *H01R 13/6456* (2013.01); *H01R 12/724* (2013.01); *H01R 13/64* (2013.01)

(58) Field of Classification Search

CPC ..... H01R 13/62; H01R 13/64
USPC ..... 439/345–358, 672–689
See application file for complete search history.

(56) References Cited

U.S. PATENT DOCUMENTS

| | | | | |
|---|---|---|---|---|
| 5,638,474 | A * | 6/1997 | Lampert et al. | 385/78 |
| 6,685,500 | B2 * | 2/2004 | Nakamura | 439/489 |
| 6,884,106 | B2 * | 4/2005 | Shuman et al. | 439/358 |
| 2006/0160399 | A1 * | 7/2006 | Dawiedczyk et al. | 439/374 |
| 2009/0269983 | A1 * | 10/2009 | Tseng | 439/607.55 |
| 2011/0065308 | A1 * | 3/2011 | Lu et al. | 439/449 |
| 2011/0269338 | A1 | 11/2011 | Lang et al. | |
| 2013/0231011 | A1 | 9/2013 | Sytsma et al. | |
| 2014/0193993 | A1 * | 7/2014 | Meng et al. | 439/352 |
| 2014/0199874 | A1 * | 7/2014 | Tseng | 439/345 |

* cited by examiner

*Primary Examiner* — Chandrika Prasad

(57) ABSTRACT

An electrical connection device comprises a standard receptacle module, a reverse receptacle module and a connector cable module. The standard receptacle module comprises a first receptacle and a first guide frame. The first guide frame has a first positioning portion. The reverse receptacle module comprises a second receptacle and a second guide frame. The second guide frame has a second positioning portion. The connector cable module comprises a standard plug, a reverse plug and a cable. The standard plug has a third positioning portion compatible with the first positioning portion. The reverse plug has a fourth positioning portion compatible with the second positioning portion. The third positioning portion of the standard plug is incompatible with the second positioning portion of the second guide frame, and the fourth positioning portion of the reverse plug is incompatible with the first positioning portion of the first guide frame.

12 Claims, 16 Drawing Sheets

ELECTRICAL CONNECTION DEVICE HAVING A STANDARD PLUG AND A REVERSE PLUG AT TWO ENDS OF A CABLE

REFERENCE TO RELATED APPLICATIONS

The Present Disclosure claims priority to prior-filed Taiwanese Utility Model Patent Application No. 102206385, entitled "Electrical Connection Device," filed on 9 Apr. 2013 with the Taiwan Intellectual Property Office; and Chinese Utility Model Patent Application No. 201320186904, entitled "Electrical Connection Device," filed on 15 Apr. 2013. The content of the aforementioned patent applications are incorporated in their entireties herein.

BACKGROUND OF THE PRESENT DISCLOSURE

The Present Disclosure relates, generally, to an electrical connection device, and, more particularly, to an electrical connection device comprising a receptacle module and a connector cable module.

Conventional I/O connectors have various transmission specifications, such as an Internal miniSAS. Taiwanese Utility Model Patent No. M384443, the content of which is hereby incorporated in its entirety herein, discloses a receptacle connector conforming to the Internal miniSAS transmission specification. In addition, Taiwanese Utility Model Patent No. M430018, the content of which is hereby incorporated in its entirety herein, discloses a plug connector conforming to the Internal miniSAS transmission specification. In this reference, the receptacle connector is engaged with a guide frame to guide a mating plug connector to be easily inserted into the receptacle connector. The plug connector disclosed by the '018 Patent comprises a latching mechanism, which may resiliently latch onto the receptacle connector as disclosed in the '443 Patent, when the above plug connector and the above receptacle connector are mated; that is, the above plug connector and the above receptacle connector are locked and positioned via the latching mechanism and the guide frame, to avoid disengagement of the plug connector and the receptacle connector.

The aforementioned plug connector is generally connected with cables, and both ends of one cable each are connected to a plug connector to form an adapter cable, by which the plug connectors at both ends of the cable can respectively mate with two receptacle connectors to transmit a signal. However, when the two receptacle connectors are respectively provided to different electronic devices, and one receptacle connector is provided over a circuit board, the other receptacle connector is provided under a circuit board, in other words, the receptacle connector provided under the circuit board rotates 180° relative to the receptacle connector provided over the circuit board, so only one plug connector must rotate 180° relative to another plug connector can the two plug connector respectively mate with the receptacle connectors, thereby resulting in twisting of the cable. Furthermore, if an engagement part of the guide frame of the receptacle connector positioned under the circuit board with the latching mechanism of the plug connector is positioned at the bottom of the receptacle connector, a user cannot see the engagement part from top to bottom. Thus, the user cannot easily position the latching mechanism and the guide frame or disengage the latch mechanism from the guide frame.

SUMMARY OF THE PRESENT DISCLOSURE

Therefore, an object of the Present Disclosure is to provide an electrical connection device which can avoid twisting of a cable, is easy to operate and has a polarizing mechanism.

According to an embodiment of an electrical connection device of the Present Disclosure, the electrical connection device comprises a standard receptacle module, a reverse receptacle module and a connector cable module. The standard receptacle module comprises a first receptacle and a first guide frame. The first receptacle has a first mating portion. The first guide frame has a first frame body, a first locking plate and a first positioning portion. The first frame body is mounted to the first receptacle, the first locking plate extends from a side of the first frame body and is spaced apart from the first mating portion and has a first locking unit. The reverse receptacle module comprises a second receptacle and a second guide frame. The second receptacle has a second mating portion. The second guide frame has a second frame body, a second locking plate and a second positioning portion. The second frame body is mounted to the second receptacle, the second locking plate extends from a side of the second frame body and is spaced apart from the second mating portion and has a second locking unit. The connector cable module comprises a standard plug, a reverse plug and a cable. The standard plug has a first casing and a third mating portion provided in the first casing and mating with the first mating portion. The first casing has a third locking unit engaging with the first locking unit and a third positioning portion compatible with the first positioning portion. The reverse plug has a second casing and a fourth mating portion provided in the second casing and mating with the second mating portion. The second casing has a fourth locking unit engaging with the second locking unit and a fourth positioning portion compatible with the second positioning portion. The cable physically connects and electrically connects the standard plug and the reverse plug. The third positioning portion of the standard plug is incompatible with the second positioning portion of the second guide frame, the fourth positioning portion of the reverse plug is incompatible with the first positioning portion of the first guide frame, so that the third mating portion of the standard plug cannot mate with the second mating portion of the reverse receptacle module, and the fourth mating portion of the reverse plug cannot mate with the first mating portion of the standard receptacle module.

In an embodiment, a positional relationship of the second receptacle relative to the second locking plate is equivalent to a positional relationship of the first receptacle after rotating 180° about an axis parallel to a mating direction relative to the first locking plate. A positional relationship of the fourth mating portion of the reverse plug relative to the fourth locking unit is equivalent to a positional relationship of the third mating portion of the standard plug after rotating 180° about the axis parallel to the mating direction relative to the third locking unit.

In an embodiment, the third mating portion comprises a first sub-circuit board and a second sub-circuit board, parallel and spaced apart from each other, and the fourth mating portion comprises a first sub-circuit board and a second sub-circuit board as another group. In the standard plug, the first sub-circuit board is positioned between the third locking unit and the second sub-circuit board, and first board surfaces of the first sub-circuit board and the second sub-circuit board face toward the third locking unit. In the reverse plug, the second sub-circuit board is positioned between the fourth locking unit and the first sub-circuit board, and second board surfaces of the first sub-circuit board and the second sub-circuit board face toward the fourth locking unit.

In an embodiment, the first receptacle is provided over a first circuit board and the first mating portion is positioned between the first locking plate and the first circuit board. The second receptacle is provided under a second circuit board and the second locking plate and the second circuit board positioned at the same side of the second mating portion.

In an embodiment, the first positioning portion of the standard receptacle module is integrally formed at a side of the first locking plate facing the first receptacle, and defines a first receiving groove which is left-right symmetrical relative to the first receptacle. The second positioning portion of the reverse receptacle module is integrally formed at a side of the second locking plate facing the second receptacle, and defines a second receiving groove which is not left-right symmetrical relative to the second receptacle. The first casing of the standard plug further has a first housing, the third locking unit and the third positioning portion are provided at a first outer side surface of the first housing, and the third positioning portion protrudes from the first outer side surface left-right symmetrically relative to the third locking unit so as to be received in the first receiving groove. The second casing of the reverse plug further has a second housing, the fourth locking unit and the fourth positioning portion are provided at a second outer side surface of the second housing, and the fourth positioning portion protrudes from the second outer side surface not left-right symmetrically relative to the fourth locking unit so as to be received in the second receiving groove.

In an embodiment, a position of the second receiving groove relative to the second receptacle offsets toward the left with respect to a position of the first receiving groove relative to the first receptacle. The third positioning portion comprises two first protective blocks which are positioned respectively on the left side and the right side of the third locking unit and are symmetrical. The fourth positioning portion comprises two second protective blocks respectively positioned on the left side and the right side of the fourth locking unit, the second protective block positioned on the left side of the fourth positioning portion enlarges toward the left with respect to first protective block positioned on the left side of the third positioning portion, and the second protective block positioned on the right side of the fourth positioning portion reduces toward the left from a right edge with respect to the first protective block positioned on the right side of the third positioning portion, so as to correspond to that the second receiving groove offsets toward the left.

In an embodiment, a position of the second receiving groove relative to the second receptacle offsets toward the right with respect to a position of the first receiving groove relative to the first receptacle. The third positioning portion comprises two first protective blocks which are positioned respectively on the left side and the right side of the third locking unit and are symmetrical; the fourth positioning portion comprises two second protective blocks respectively positioned on the left side and the right side of the fourth locking unit, and the second protective block positioned on the right side of the fourth positioning portion enlarges toward the right with respect to the first protective block positioned on the right side of the third positioning portion, and the second protective block positioned on the left side of the fourth positioning portion reduces toward the right from a left edge with respect to the first protective block positioned on the left side of the third positioning portion, so as to correspond to that the second receiving groove offsets toward the right.

According to another embodiment of an electrical connection device of the Present Disclosure, the electrical connection device comprises a standard receptacle module, a reverse receptacle module and a connector cable module. The standard receptacle module comprises two first receptacles and a first guide frame. The two first receptacles each have a first mating portion. The first guide frame has a first frame body, a first locking plate and a first positioning portion. The first frame body is mounted to the first receptacles and makes the first mating portions spaced apart from each other and provided side by side, the first locking plate extends from a side of the first frame body and is spaced apart from the first mating portions and has two first locking units respectively corresponding to the first mating portions. The reverse receptacle module comprises two second receptacles and a second guide frame. The two second receptacles each have a second mating portion. The second guide frame has a second frame body, a second locking plate and a second positioning portion. The second frame body is mounted to the second receptacles and makes the second mating portions spaced apart from each other and provided side by side, the second locking plate extends from a side of the second frame body and is spaced apart from the second mating portions and has two second locking units respectively corresponding to the second mating portions. The connector cable module comprises a standard plug, a reverse plug and a cable. The standard plug has a first casing and two third mating portions provided in the first casing and respectively mating with the first mating portions. The first casing has two third locking units respectively engaging with the first locking units and a third positioning portion compatible with the first positioning portion. The reverse plug has a second casing and two fourth mating portions provided in the second casing and respectively mating with the second mating portions. The second casing has two fourth locking units respectively engaging with the second locking units and a fourth positioning portion compatible with the second positioning portion. The cable physically connects and electrically connects the standard plug and the reverse plug. The third positioning portion of the standard plug is incompatible with the second positioning portion of the second guide frame, the fourth positioning portion of the reverse plug is incompatible with the first positioning portion of the first guide frame, so that the third mating portion of the standard plug cannot mate with the second mating portion of the reverse receptacle module, and the fourth mating portion of the reverse plug cannot mate with the first mating portion of the standard receptacle module.

In an embodiment, a positional relationship of the second receptacles relative to the second locking plate is equivalent to a positional relationship of the first receptacles after rotating 180° about the axis parallel to a mating direction relative to the first locking plate, respectively. A positional relationship of the fourth mating portions of the reverse plug relative to the fourth locking unit is equivalent to a positional relationship of the third mating portions of the standard plug after rotating 180° about the axis parallel to the mating direction relative to the third locking units, respectively.

In an embodiment, the third mating portions each comprise a first sub-circuit board and a second sub-circuit board which are parallel and spaced apart from each other, and the fourth mating portions each comprise a first sub-circuit board and a second sub-circuit board as another group. In the standard plug, the first sub-circuit board of the each third mating portion is positioned between the corresponding third locking unit and the second sub-circuit board of the each third mating portion, and first board surfaces of the first sub-circuit board and the second sub-circuit board of the each third mating portion face toward the corresponding third locking unit. In the reverse plug, the second sub-circuit board of the each fourth mating portion is positioned between the corresponding fourth locking unit and the first sub-circuit board of the each fourth mating portion, and second board surfaces of the first sub-circuit board and the second sub-circuit board of the each fourth mating portion face toward the corresponding fourth locking unit.

In an embodiment, the first receptacles are provided over a first circuit board and the first mating portions are positioned between the first locking plate and the first circuit board. The second receptacles are provided under a second circuit board and the second locking plate and the second circuit board positioned at the same side of the second mating portions.

In an embodiment, the first positioning portion of the standard receptacle module is integrally formed at a side of the first locking plate facing the first receptacles, and defines two first receiving grooves which are respectively left-right symmetrical relative to the first receptacles and comprises a first spacer positioned between the first receiving grooves. The second positioning portion of the reverse receptacle module is integrally formed at the side of the second locking plate facing the second receptacles, and defines two second receiving grooves which are respectively not left-right symmetrical relative to the second receptacles and comprises a second spacer positioned between the second receiving grooves, and positions of the second receiving grooves relative to the second receptacles offset toward the left and the right respectively with respect to positions of the first receiving grooves relative to the first receptacles so that the second spacer is wider than the first spacer. The first casing of the standard plug further has a first housing, the third locking units and the third positioning portion are provided at a first outer side surface of the first housing, and the third positioning portion comprises four first protective blocks, every two first protective blocks are respectively positioned on the left side and the right side of one third locking unit, so as to be correspondingly received in the one first receiving groove, and the two adjacent first protective blocks positioned in the middle together define a first receiving space to engage with and receive the first spacer. The second casing of the reverse plug further has a second housing, the fourth locking units and the fourth positioning portion are provided at a second outer side surface of the second housing, and the fourth positioning portion comprises four second protective blocks, every two second protective blocks are respectively positioned on the left side and the right side of one fourth locking unit, so as to be correspondingly received in the one second receiving groove, and widths of the two adjacent second protective blocks positioned in the middle are smaller than widths of the two second protective blocks positioned outside to together define a second receiving space, the second receiving space is wider than the first receiving space to engage with and receive the second spacer, and the two second protective blocks positioned outside respectively extend outwardly toward the left and the right with respect to the two first protective blocks of the standard plug positioned outside so as to correspond to that the second receiving grooves respectively offset toward the left and the right.

The Present Disclosure has, at least, the following effect: The latching components of the standard receptacle module and the standard plug and the reverse receptacle module and the reverse plug of the above embodiments all are positioned at the tops thereof respectively, so that the user can easily operate and avoid twisting of the cable, the polarizing mechanism is further provided, so as to avoid incorrect insertion.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
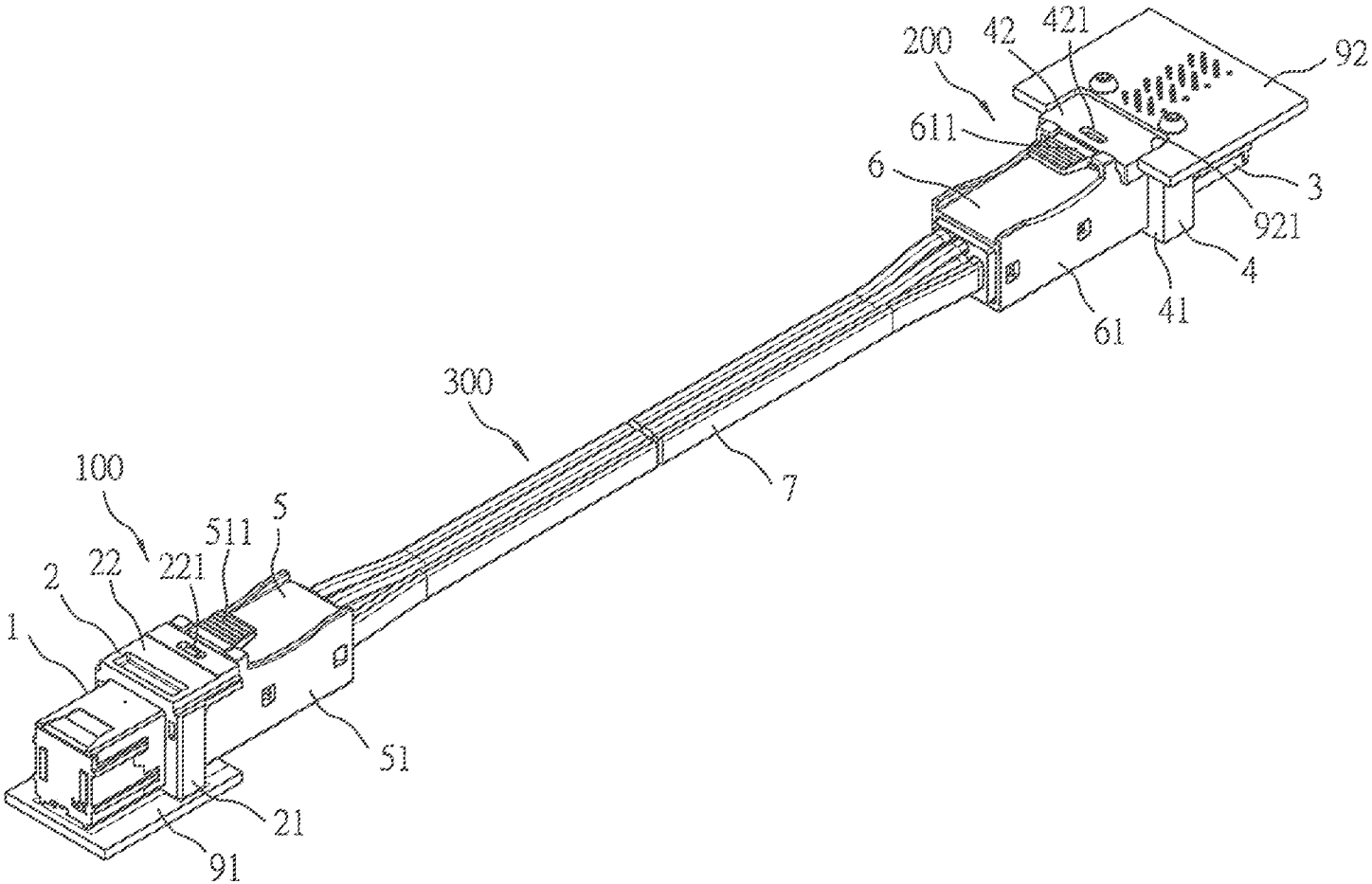
FIG. 1 is a perspective view illustrating an embodiment of an electrical connection device of the Present Disclosure.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly. Additionally, like elements are indicated by like reference numerals herein.

Referring to FIGS. 1-4, a first embodiment of an electrical connection device of the Present Disclosure comprises a standard receptacle module 100, a reverse receptacle module 200 and a connector cable module 300. The standard receptacle module 100 comprises a first receptacle 1 and a first guide frame 2. The first receptacle 1 is provided over a first circuit board 91 and has a first mating portion 11. The first guide frame 2 has a first frame body 21, a first locking plate 22 and a first positioning portion 23. The first frame body 21 is mounted to the first receptacle 1. The first locking plate 22 extends from a side of the first frame body 21 and is spaced apart from the first mating portion 11 and has a first locking unit 221. Specifically, the first mating portion 11 is positioned between the first locking plate 22 and the first circuit board 91.

The reverse receptacle module 200 comprises a second receptacle 3 and a second guide frame 4. The second receptacle 3 is provided under a second circuit board 92 and has a second mating portion 31. The second guide frame 4 has a second frame body 41, a second locking plate 42 and a second positioning portion 43. The second frame body 41 is mounted to the second receptacle 3. The second locking plate 42 extends from a side of the second frame body 41 and is spaced apart from the second mating portion 31 and has a second locking unit 421. Specifically, the second locking plate 42 and the second circuit board 92 are positioned at the same side of the second mating portion 31, and the second circuit board 92 has a cutout 921 to allow the second locking plate 42 to be exposed. In the embodiment, the first locking unit 221 and the second locking unit 421 each are a latching hole.

Configurations of the first receptacle 1 and the second receptacle 3 are identical, the first circuit board 91 and the second circuit board 92 are provided horizontally. The first receptacle 1 is mounted to the first circuit board 91 with terminal soldering legs 12 thereof facing downwardly. The second receptacle 3 is mounted to the second circuit board 92 with terminal soldering legs 32 thereof facing upwardly; that is, the second receptacle 3 rotates 180° relative to the first receptacle 1. The first guide frame 2 is assembled to the first receptacle 1 and the first locking plate 22 is positioned at the top of the first guide frame 2. The second guide frame 4 is assembled to the second receptacle 3 and the second locking plate 42 also is positioned at the top of the second guide frame 4, thus, a positional relationship of the second receptacle 3 relative to the second locking plate 42 is equivalent to a positional relationship of the first receptacle 1 after rotating 180° about an axis parallel to a mating direction A relative to the first locking plate 22.

Figure 5:
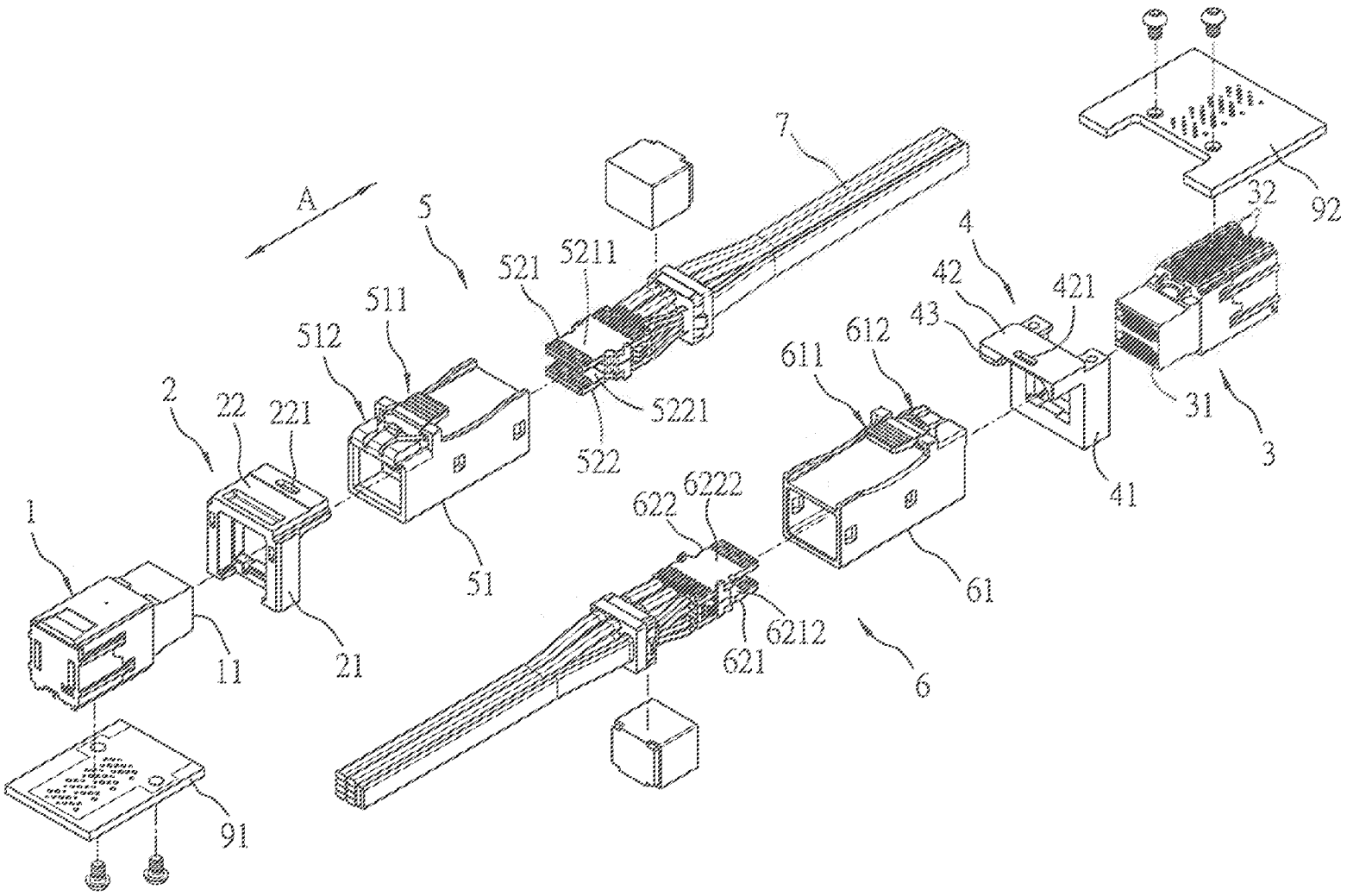
FIG. 5 is a further exploded view of FIG. 2, illustrating a mating portion of the plug of the embodiment of FIG. 1.
Figure 6:
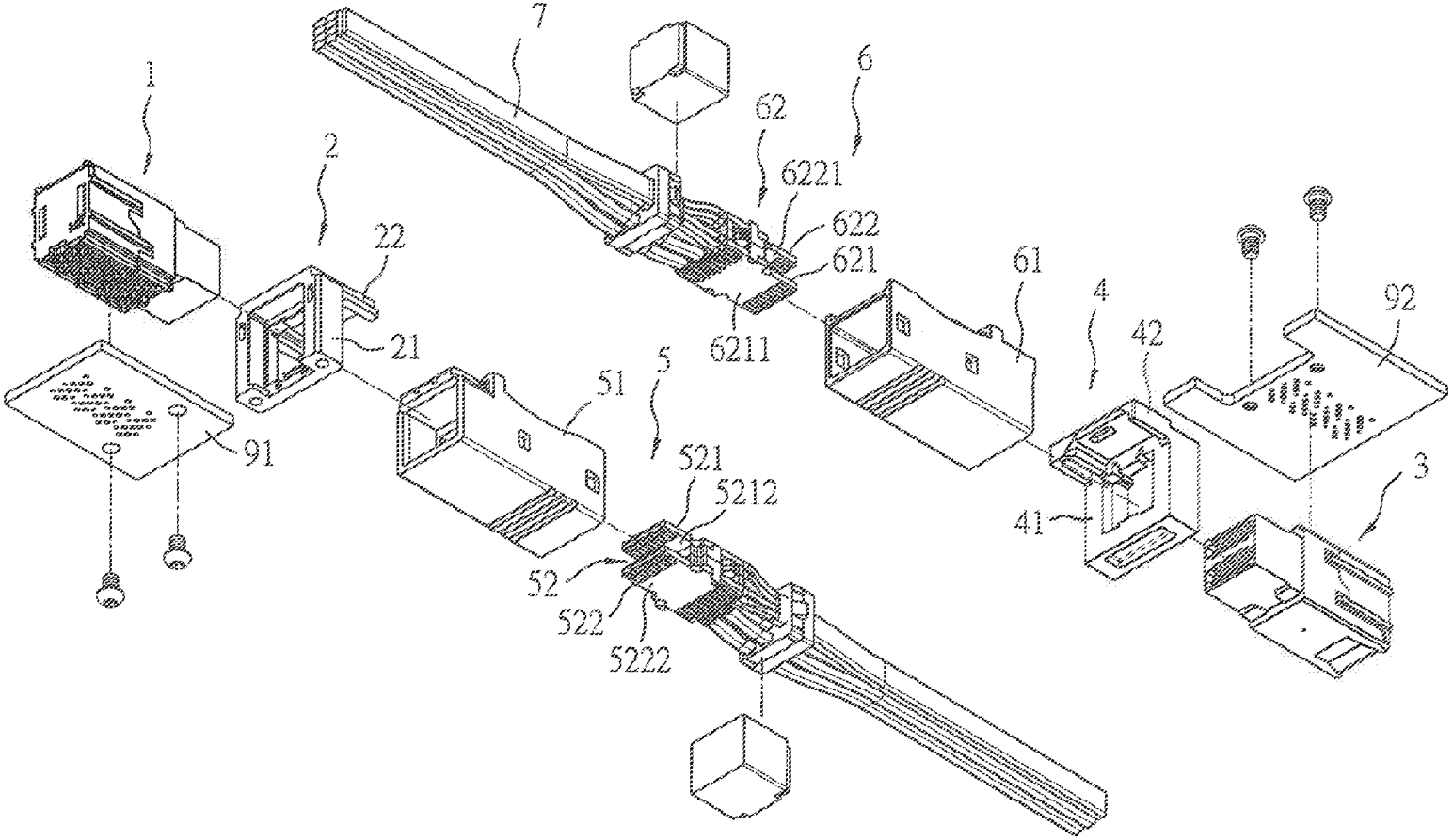
FIG. 6 is a view of FIG. 5 from another angle.

Referring to FIGS. 1 and 5-6, the connector cable module 300 comprises a standard plug 5, a reverse plug 6 and a cable 7. The cable 7 physically connects and electrically connects the standard plug 5 and the reverse plug 6. The standard plug 5 has a first casing 51 and a third mating portion 52 provided in the first casing 51 and mating with the first mating portion 11. The first casing 51 has a third locking unit 511 engaging with the first locking unit 221 and a third positioning portion 512 compatible with the first positioning portion 23 (referring to FIG. 4). The reverse plug 6 has a second casing 61 and a fourth mating portion 62 provided in the second casing 61 and mating with the second mating portion 31. The second casing 61 has a fourth locking unit 611 engaging with the second locking unit 421 and a fourth positioning portion 612 compatible with the second positioning portion 43.

Specifically, the third mating portion 52 comprises a first sub-circuit board 521 and a second sub-circuit board 522 which are parallel and spaced apart from each other, and the fourth mating portion 62 comprises a first sub-circuit board 621 and a second sub-circuit board 622 as another group. That is, configurations of the third mating portion 52 and the fourth mating portion 62 are identical. The first sub-circuit board 521 and the second sub-circuit board 522 of the third mating portion 52 respectively have a first board surface 5211, 5221 and a second board surface 5212, 5222. Similarly, the first sub-circuit board 621 and the second sub-circuit board 622 of the fourth mating portion 62 respectively have a first board surface 6211, 6221 and a second board surface 6212, 6222. In the standard plug 5, the first sub-circuit board 521 is positioned between the third locking unit 511 and the second sub-circuit board 522, and the first board surfaces 5211, 5221 of the first sub-circuit board 521 and the second sub-circuit board 522 face toward the third locking unit 511. However in the reverse plug 6, the second sub-circuit board 622 is positioned between the fourth locking unit 611 and the first sub-circuit board 621, and the second board surfaces 6212, 6222 of the first sub-circuit board 621 and the second sub-circuit board 622 face toward the fourth locking unit 611. In simple terms, the third locking unit 511 is positioned at the top of the standard plug 5 and the fourth locking unit 611 is positioned at the top of the reverse plug 6, and a positional relationship of the fourth mating portion 62 relative to the fourth locking unit 611 is equivalent to a positional relationship of the third mating portion 52 after rotating 180° about the axis parallel to the mating direction A relative to the third locking unit 511. In this way, the standard plug 5 can mate with the corresponding standard receptacle module 100 to establish an electrical connection, and the reverse plug 6 can mate with the corresponding reverse receptacle module 200 to establish an electrical connection.

Referring to FIGS. 2 and 7-9, the first positioning portion 23 of the standard receptacle module 100 is integrally formed at a side of the first locking plate 22 facing the first receptacle 1, and defines a first receiving groove 231 which is left-right symmetrical relative to the first receptacle 1. The first casing 51 of the standard plug 5 further has a first housing 513, the third locking unit 511 and the third positioning portion 512 are provided at a first outer side surface 5131 of the first housing 513, and the third positioning portion 512 protrudes from the first outer side surface 5131 left-right symmetrically relative to the third locking unit 511 so as to be received in the first receiving groove 231. In the embodiment, the third locking unit 511 has a resilient arm 5111 and a latching block 5112 driven by the resilient arm 5111. The latching block 5112 of the third locking unit 511 can be inserted into the first locking unit 221 (latching hole). The third positioning portion 512 comprises two first protective blocks 5121, 5122 which are positioned respectively on the left side and the right side of the third locking unit 511 and are symmetrical, so as to protect the resilient arm 5111 against damage due to a lateral force.

Figure 2:
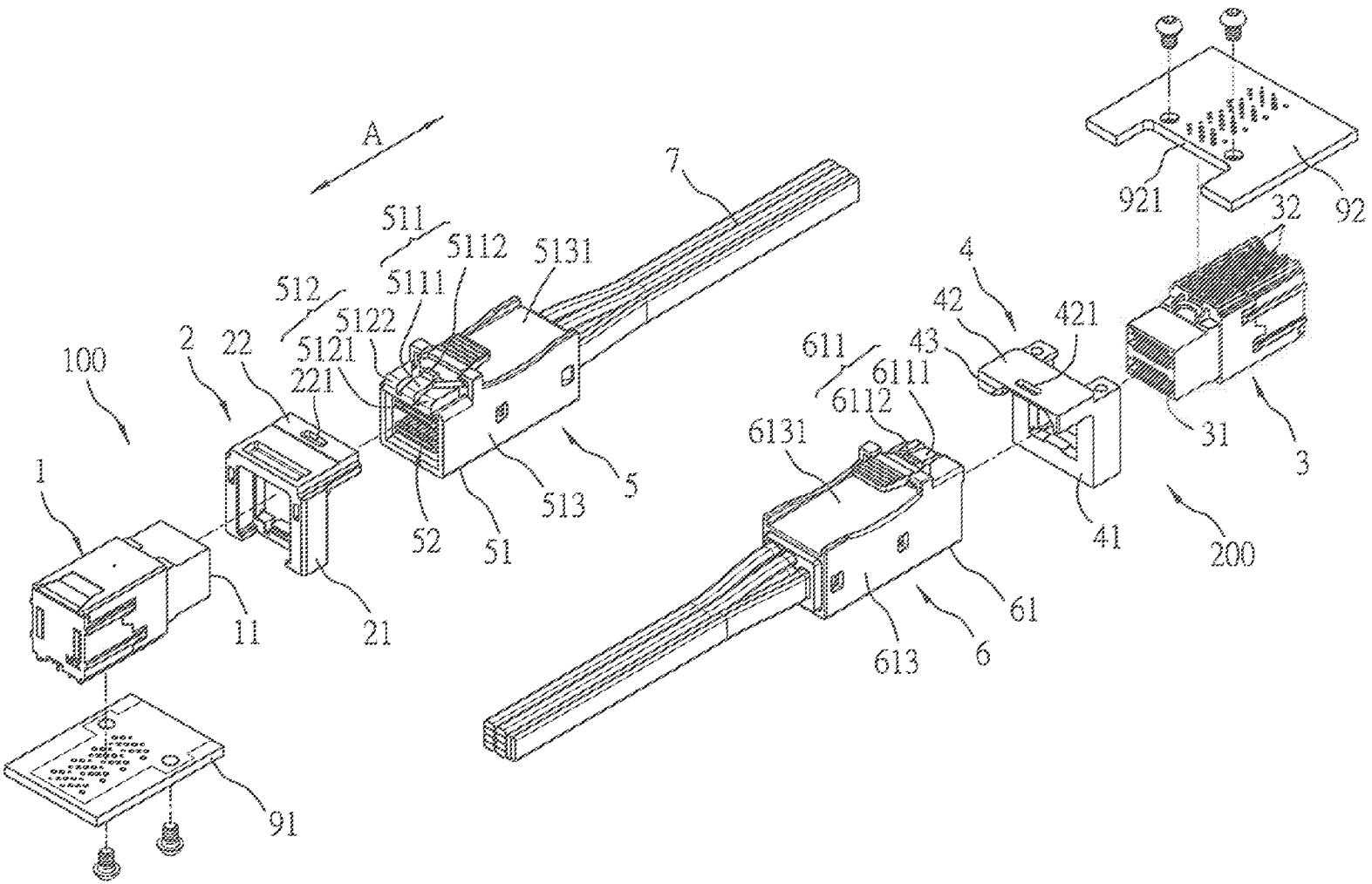
FIG. 2 is an exploded perspective view illustrating assembly relationship of components of the electrical connection device of FIG. 1.
Figure 3:
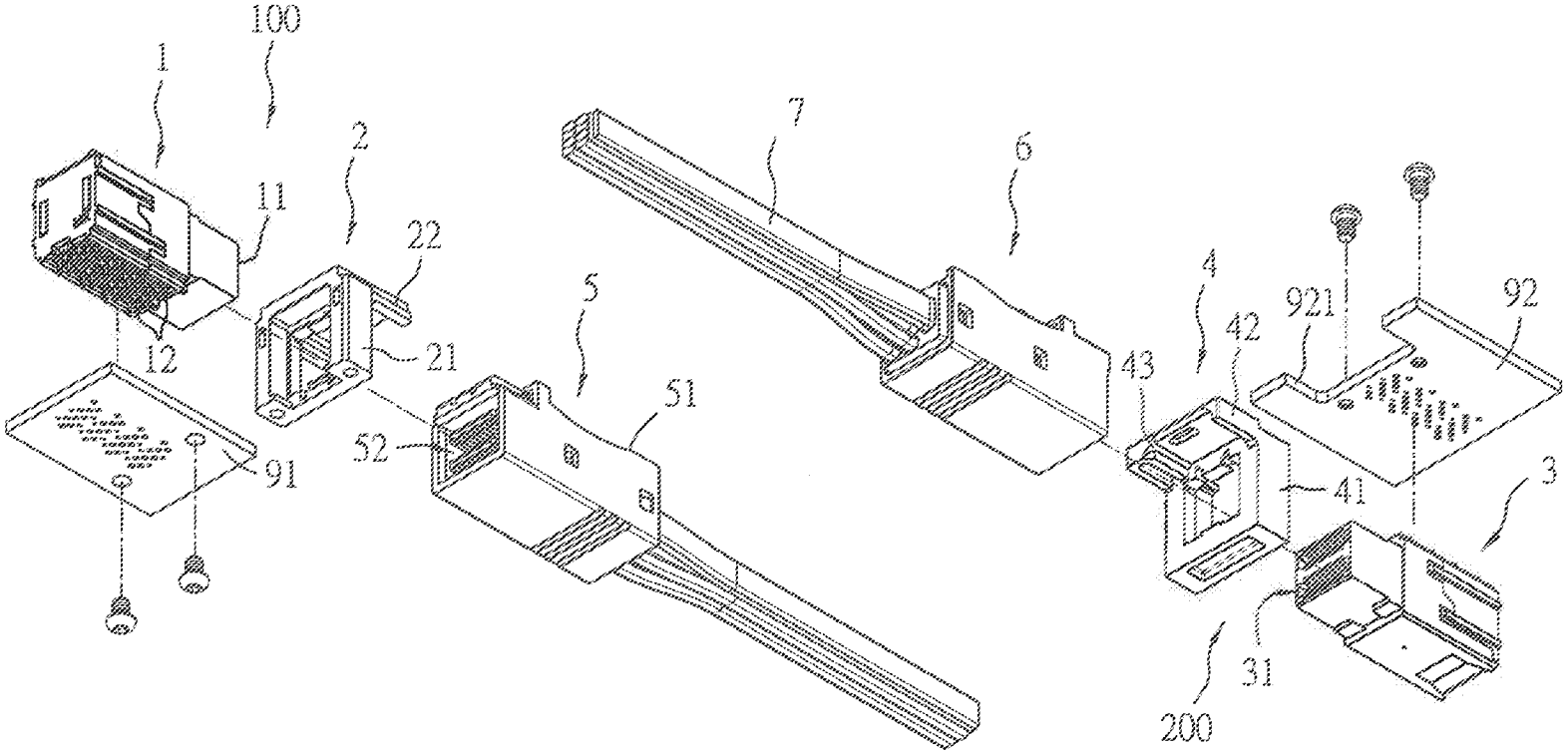
FIG. 3 is a view of FIG. 2 from another angle.
Figure 4:
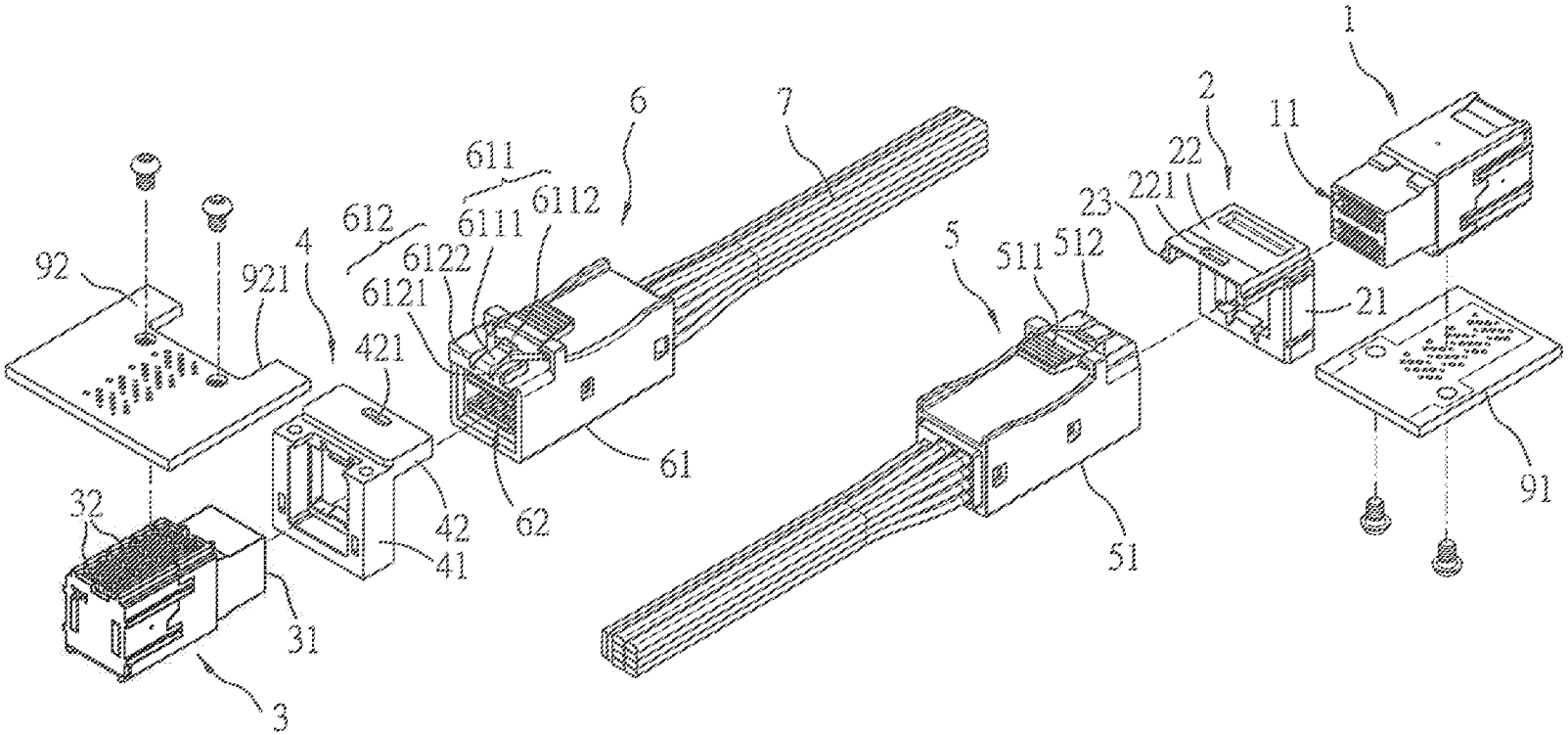
FIG. 4 is a view of FIG. 2 from another angle.
Figure 9:
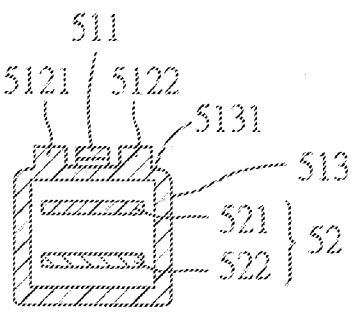
FIG. 9 is a cross-sectional view taken along Line IX-IX of FIG. 8.
Figure 8:
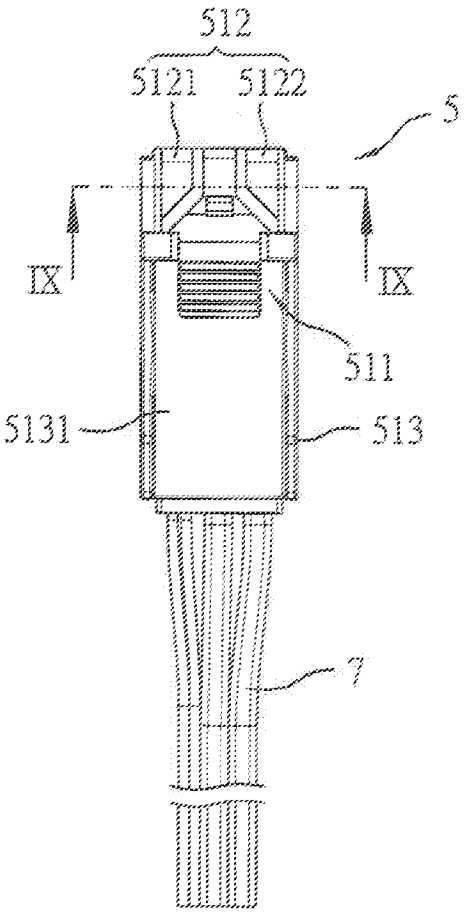
FIG. 8 is a top view illustrating a standard plug of the embodiment of FIG. 1.
Figure 7:
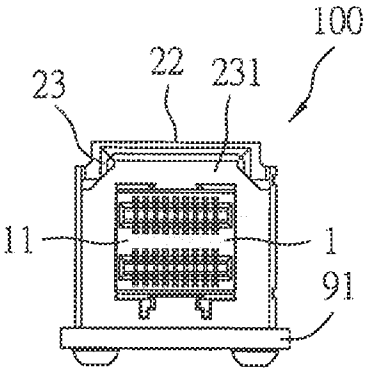
FIG. 7 is a front view illustrating a standard receptacle module of the embodiment of FIG. 1.
Figure 12:
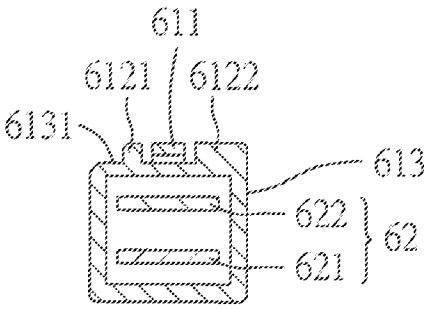
FIG. 12 is a cross-sectional view taken along Line XII-XII of FIG. 11.
Figure 11:
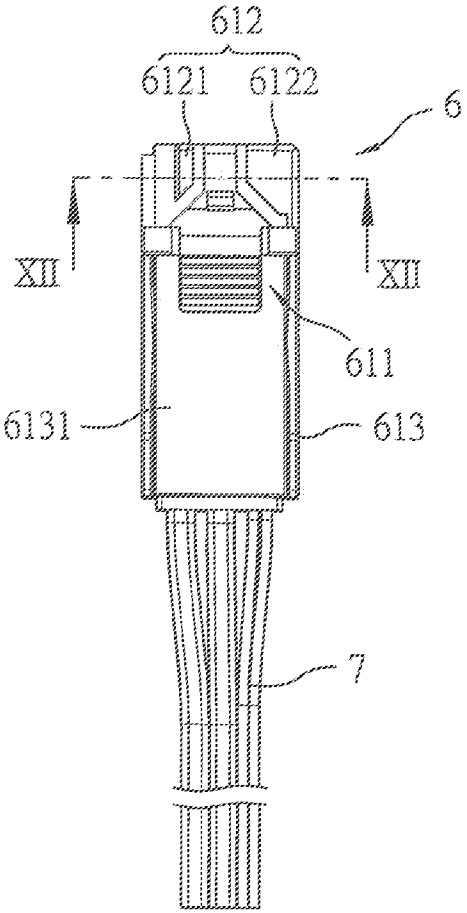
FIG. 11 is a top view illustrating a reverse plug of the embodiment of FIG. 1.
Figure 10:
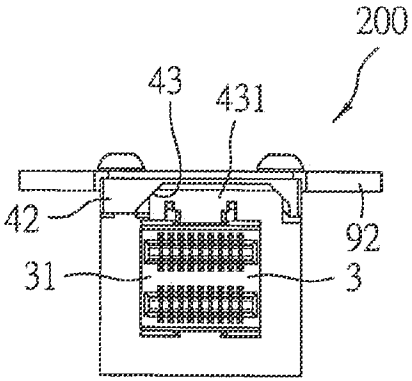
FIG. 10 is a front view illustrating a reverse receptacle module of the embodiment of FIG. 1.

Referring to FIG. 10, the second positioning portion 43 of the reverse receptacle module 200 is integrally formed at a side of the second locking plate 42 facing the second receptacle 3, and defines a second receiving groove 431 which is not left-right symmetrical relative to the second receptacle 3. Referring to FIGS. 7 and 10, a position of the second receiving groove 431 relative to the second receptacle 3 offsets toward the right with respect to a position of the first receiving groove 231 relative to the first receptacle 1. Referring to FIGS. 2 and 10-2, the second casing 61 of the reverse plug 6 further has a second housing 613. The fourth locking unit 611 and the fourth positioning portion 612 are provided at a second outer side surface 6131 of the second housing 613, and the fourth positioning portion 612 protrudes from the second outer side surface 6131 not left-right symmetrically relative to the fourth locking unit 611 so as to be received in the second receiving groove 431. In the embodiment, similarly, the fourth locking unit 611 has a resilient arm 6111 and a latching block 6112 driven by the resilient arm 6111. The latching block 6112 of the fourth locking unit 611 can be inserted into the second locking unit 421 (latching hole). The fourth positioning portion 612 comprises two second protective blocks 6121, 6122 respectively positioned on the left side and the right side of the fourth locking unit 611, and the second protective block 6122 positioned on the right side of the fourth positioning portion 612 enlarges toward the right with respect to the first protective block 5122 (referring to FIGS. 8-9) positioned on the right side of the third positioning portion 512, and the second protective block 6121 positioned on the left side of the fourth positioning portion 612 reduces toward the right from a left edge with respect to the first protective block 5121 (referring to FIGS. 8-9) positioned on the left side of the third positioning portion 512, so as to correspond to that the second receiving groove 431 offsets toward the right. In this way, the third positioning portion 512 of the standard plug 5 is incompatible with the second positioning portion 43 of the second guide frame 4 of the reverse receptacle module 200, when a user will insert the standard plug 5 into the reverse receptacle module 200, the first protective block 5121 positioned on the left side cannot enter into the second receiving groove 431, so that the third mating portion 52 of the standard plug 5 cannot mate with the second mating portion 31 of the reverse receptacle module 200. Furthermore, the fourth positioning portion 612 of the reverse plug 6 is incompatible with the first positioning portion 23 of the first guide frame 2 of the standard receptacle module 100, when the user will insert the reverse plug 6 into the standard receptacle module 100, the second protective block 6122 positioned on the right side cannot enter into the first receiving groove 231, so that the fourth mating portion 62 of the reverse plug 6 cannot mate with the first mating portion 11 of the standard receptacle module 100. So, it can be ensured that the standard plug 5 can only establish an electrical connection with the standard receptacle module 100, and the reverse plug 6 can only establish an electrical connection with the reverse receptacle module 200, incorrect insertion will not occur.

Further referring to FIG. 1, as the first locking unit 221 of the standard receptacle module 100, the third locking unit 511 of the standard plug 5, the second locking unit 421 of the reverse receptacle module 200 and the fourth locking unit 611 of the reverse plug 6 all are positioned at the tops thereof respectively, the user can see all of them so as to facilitate operation, and avoid twisting of the cable 7.

Figure 13:
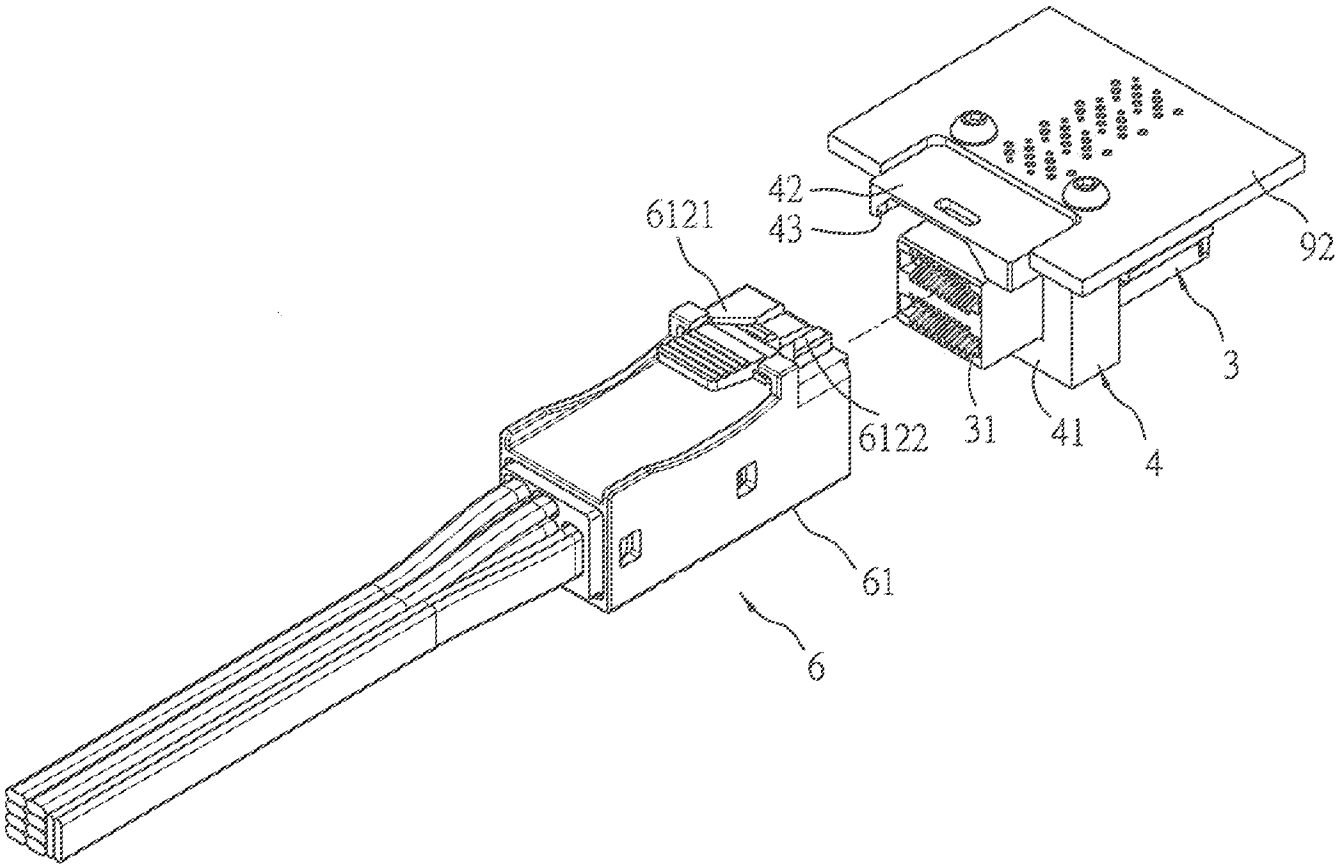
FIG. 13 is a perspective view illustrating another embodiment of the electrical connection device of the Present Disclosure.
Figure 16:
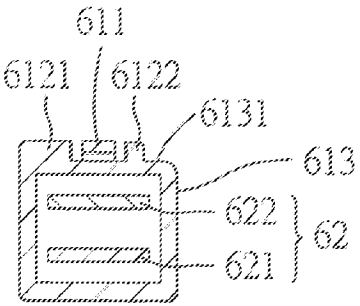
FIG. 16 is a cross-sectional view taken along Line XVI-XVI of FIG. 15.
Figure 15:
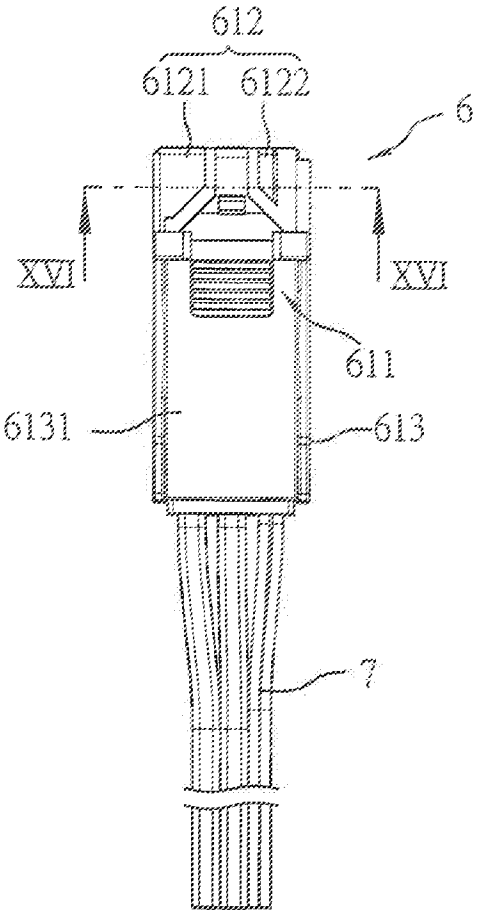
FIG. 15 is a top view illustrating a reverse plug of the embodiment of FIG. 13.
Figure 14:
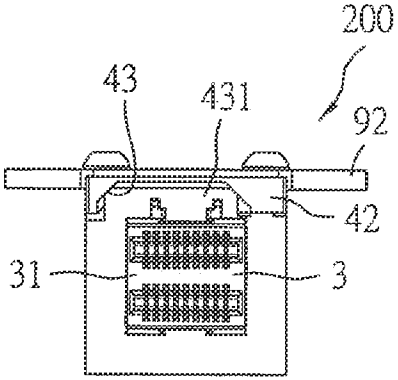
FIG. 14 is a front view illustrating a reverse receptacle module of the embodiment of FIG. 13.

Referring to FIGS. 13-6, a second embodiment of the electrical connection device of the Present Disclosure is substantially the same as the first embodiment, but, in the second embodiment, the position of the second receiving groove 431 of the reverse receptacle module 200 relative to the second receptacle 3 offsets toward the left with respect to the position of the first receiving groove 231 (referring to FIG. 7) relative to the first receptacle 1. And, the second protective block 6121 positioned on the left side of the fourth positioning portion 612 of the reverse plug 6 enlarges toward the left with respect to first protective block 5121 (referring to FIGS. 8-9) positioned on the left side of the third positioning portion 512, and the second protective block 6122 positioned on the right side of the fourth positioning portion 612 reduces toward the left from a right edge with respect to the first protective block 5122 (referring to FIGS. 8-9) positioned on the right side of the third positioning portion 512, so as to correspond to that the second receiving groove 431 offsets toward the left. In this way, the third positioning portion 512 of the standard plug 5 is incompatible with the second positioning portion 43 of the second guide frame 4 of the reverse receptacle module 200, when the user will insert the standard plug 5 into the reverse receptacle module 200, the first protective block 5122 positioned on the right side cannot enter into the second receiving groove 431, so that the third mating portion 52 of the standard plug 5 cannot mate with the second mating portion 31 of the reverse receptacle module 200. Furthermore, the fourth positioning portion 612 of the reverse plug 6 is incompatible with the first positioning portion 23 of the first guide frame 2 of the standard receptacle module 100, when the user will insert the reverse plug 6 into the standard receptacle module 100, the second protective block 6121 positioned on the left side cannot enter into the first receiving groove 231, so that the fourth mating portion 62 of the reverse plug 6 cannot mate with the first mating portion 11 of the standard receptacle module 100. So, it can also be ensured that the standard plug 5 can only establish an electrical connection with the standard receptacle module 100, and the reverse plug 6 can only establish an electrical connection with the reverse receptacle module 200, incorrect insertion will not occur.

Figure 17:
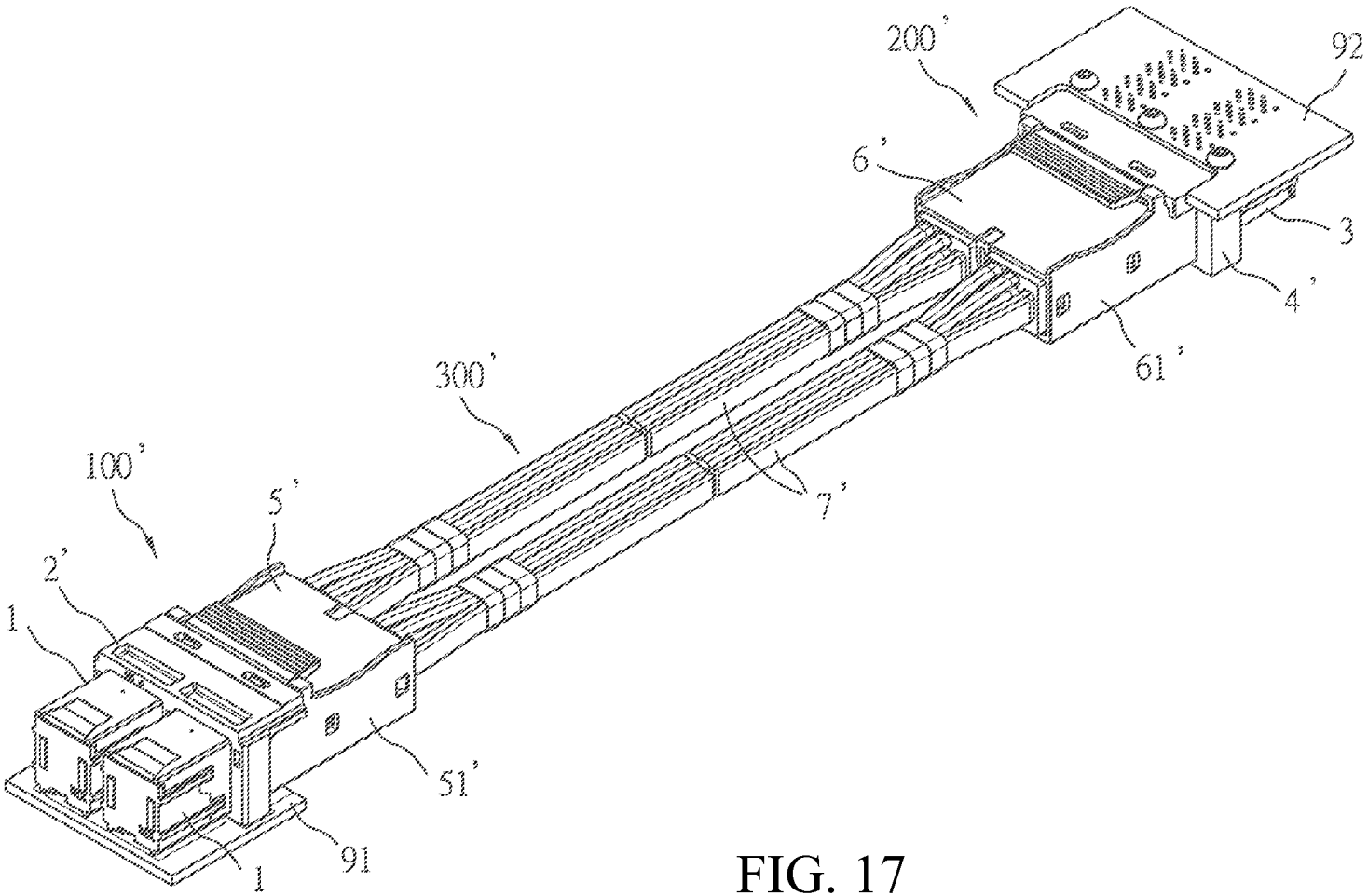
FIG. 17 is a perspective view illustrating another embodiment of an electrical connection device of the Present Disclosure.
Figure 18:
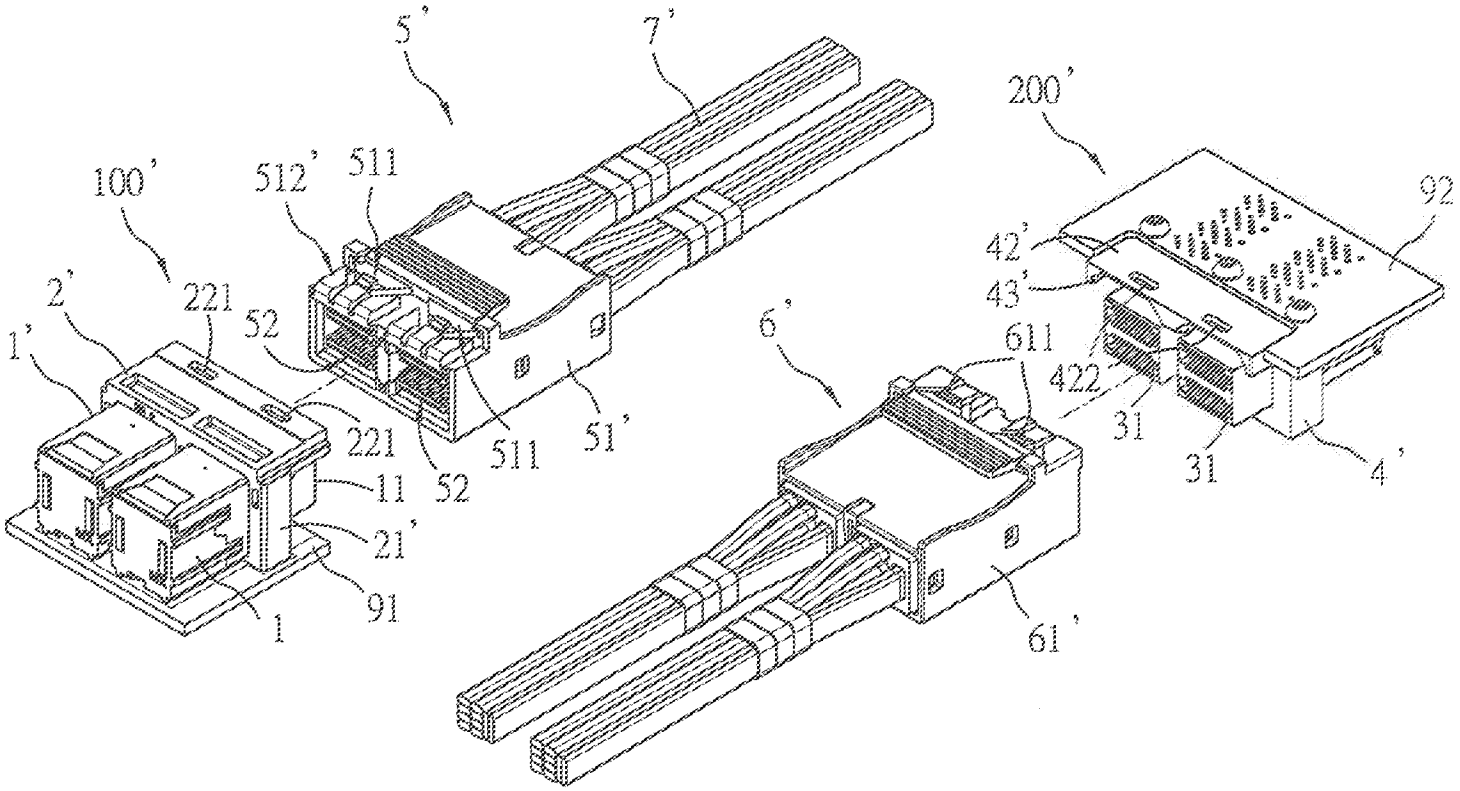
FIG. 18 is a perspective view illustrating the embodiment of FIG. 17.
Figure 19:
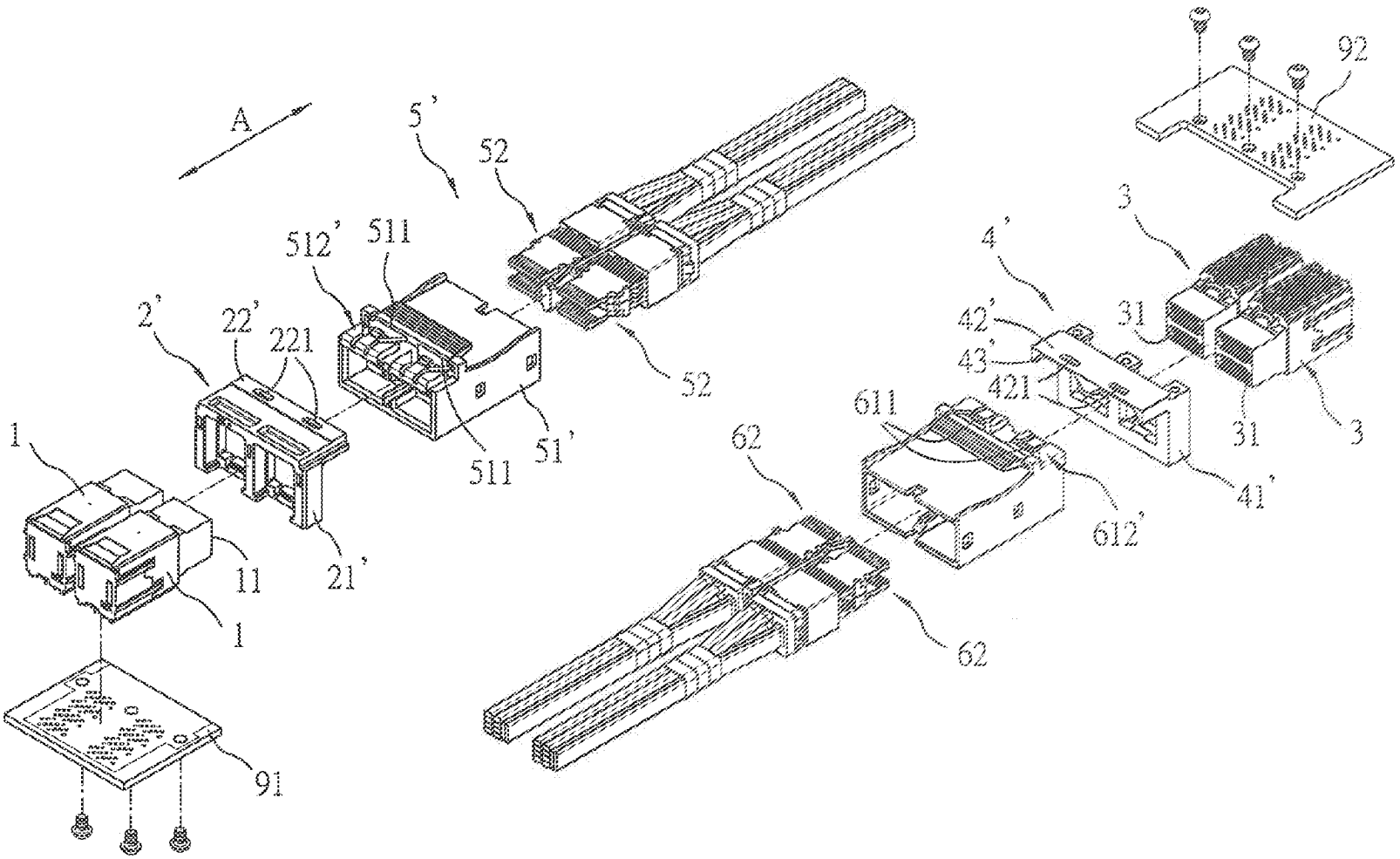
FIG. 19 is an exploded perspective view illustrating the embodiment of FIG. 17.
Figure 21:
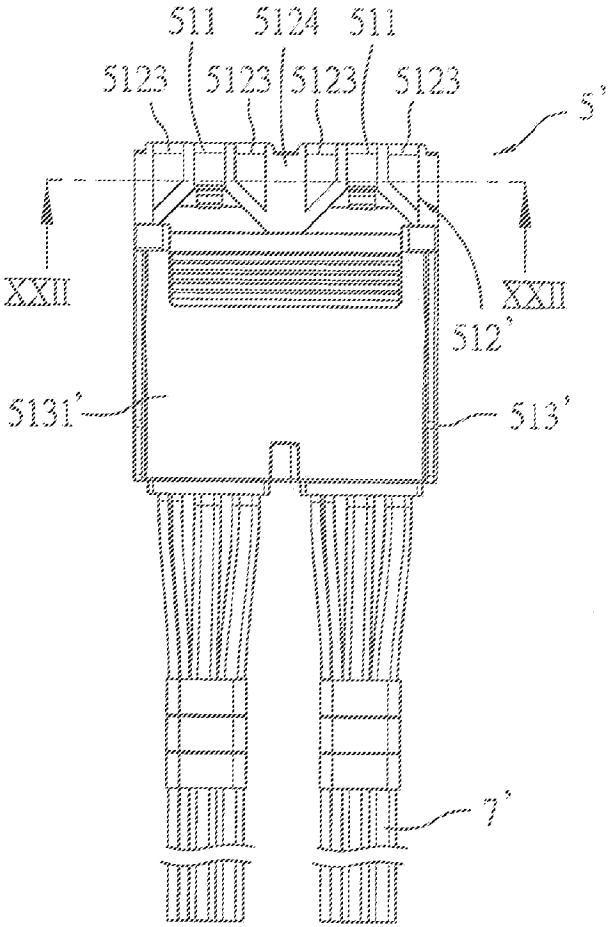
FIG. 21 is a top view illustrating a standard plug of the embodiment of FIG. 17.

Referring to FIGS. 17-9, a third embodiment of the electrical connection device of the Present Disclosure is a configuration of dual plug-receptacle provided side by side. The third embodiment also comprises a standard receptacle module 100', a reverse receptacle module 200' and a connector cable module 300'. However, in the third embodiment, the standard receptacle module 100' is equivalent to an assembly of two standard receptacle modules 100 (such as that in the first embodiment) side by side, and the two first guide frames 2 are connected to form a single first guide frame 2' integrally formed. The reverse receptacle module 200' is equivalent to an assembly of a reverse receptacle module 200 (such as that in the first embodiment) and a reverse receptacle module 200 (such as that in the second embodiment) side by side, and the second guide frames 4 are connected to form a single second guide frame 4' integrally formed. Similarly, the connector cable module 300' comprises a standard plug 5', a reverse plug 6' and a cable 7' physically connecting and electrically connecting the standard plug 5' and the reverse plug 6'. The standard plug 5' is also equivalent to an assembly of two standard plugs 5 (such as that in the first embodiment) side by side, and the two first casings 51 are connected to form a single first casing 51' integrally formed to engage with the first guide frame 2'. And the reverse plug 6' is equivalent to an assembly of a reverse plug 6 (such as that in the first embodiment) and a reverse plug 6 (such as that in the second embodiment) side by side, and the second casings 61 are connected to form a single second casing 61' integrally formed to match the second guide frame 4'.

Specifically, the standard receptacle module 100' comprises two first receptacles 1 and a first guide frame 2'. The first receptacles 1 each have a first mating portion 11. The first guide frame 2' has a first frame body 21', a first locking plate 22' and a first positioning portion 23' (referring to FIG. 20), the first frame body 21' is mounted to the first receptacles 1 and makes the first mating portions 11 spaced apart from each other and provided side by side. The first locking plate 22' extends from a side of the first frame body 21' and is spaced apart from the first mating portions 11 and has two first locking units 221 respectively corresponding to the first mating portions 11. The reverse receptacle module 200' comprises two second receptacles 3 and a second guide frame 4'. The second receptacles 3 each have a second mating portion 31. The second guide frame 4' has a second frame body 41', a second locking plate 42' and a second positioning portion 43'. The second frame body 41' is mounted to the second receptacles 3 and makes the second mating portions 31 spaced apart from each other and provided side by side. The second locking plate 42' extends from a side of the second frame body 41' and is spaced apart from the second mating portions 31 and has two second locking units 421 respectively corresponding to the second mating portions 31. A positional relationship of the second receptacles 3 relative to the second locking plate 42' is equivalent to a positional relationship of the first receptacles 1 after rotating 180° about the axis parallel to the mating direction A relative to the first locking plate 22', respectively.

The standard plug 5' has a first casing 51' and two third mating portions 52 provided in the first casing 51' and respectively mating with the first mating portions 11. The first casing 51' has two third locking units 511 respectively engaging with the first locking units 221 and a third positioning portion 512' compatible with the first positioning portion 23'. The reverse plug 6' has a second casing 61' and two fourth mating portions 62 provided in the second casing 61' and respectively mating with the second mating portions 31. The second casing 61' has two fourth locking units 611 respectively engaging with the second locking units 421 and a fourth positioning portion 612' compatible with the second positioning portion 43'. A positional relationship of the fourth mating portions 62 of the reverse plug 6' relative to the fourth locking units 611 is equivalent to a positional relationship of the third mating portions 52 of the standard plug 5' after rotating 180° about the axis parallel to the mating direction A relative to the third locking units 511, respectively.

Figure 20:
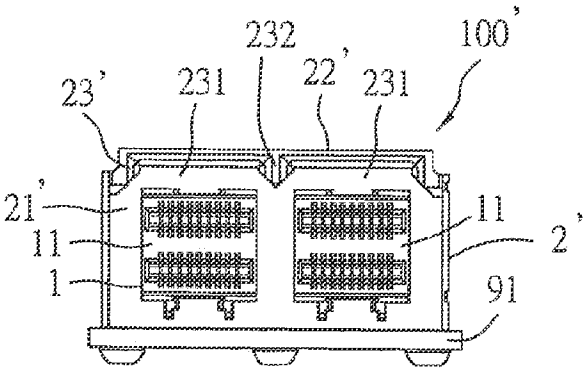
FIG. 20 is a front view illustrating a standard receptacle module of the embodiment of FIG. 17.
Figure 23:
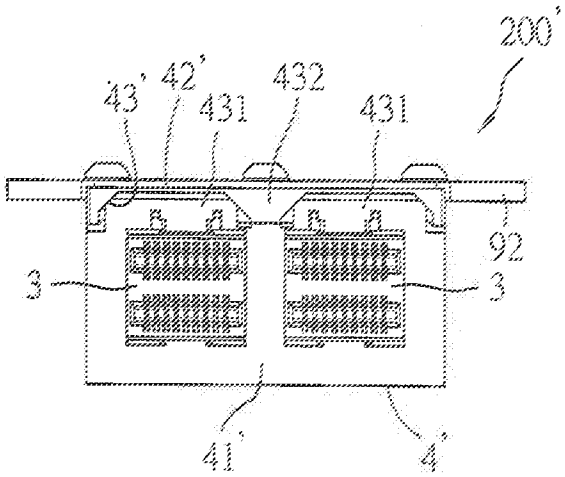
FIG. 23 is a front view illustrating a reverse receptacle module of the embodiment of FIG. 21.
Figure 22:
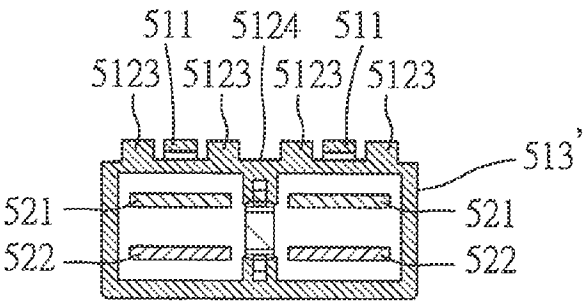
FIG. 22 is a cross-sectional view taken along Line XXII-XXII of FIG. 21.
Figure 25:
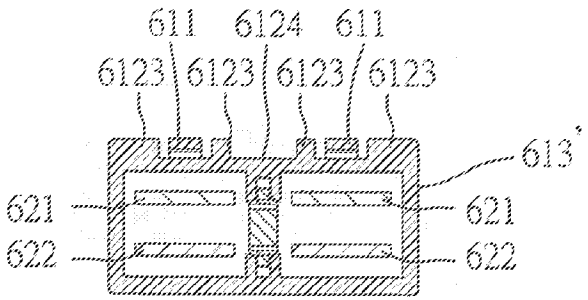
FIG. 25 is a cross-sectional view taken along Line XXV-XXV of FIG. 24.
Figure 24:
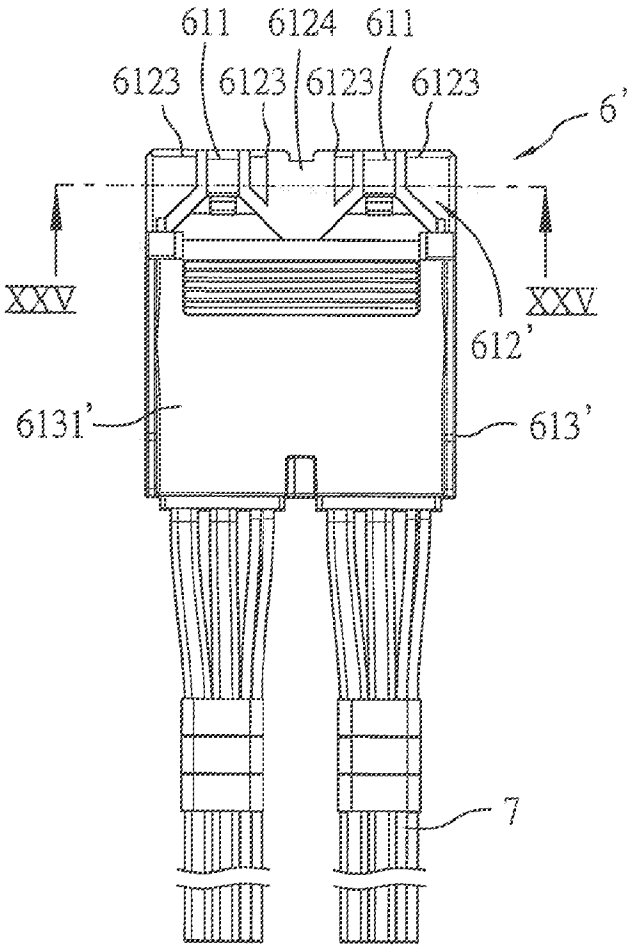
FIG. 24 is a top view illustrating a reverse plug of the embodiment of FIG. 21.

Referring to FIGS. 20-5, the first positioning portion 23' of the standard receptacle module 100' is integrally formed at a side of the first locking plate 22' facing the first receptacles 1, and defines two first receiving grooves 231 which are respectively left-right symmetrical relative to the first receptacles 1, and comprises a first spacer 232 positioned between the first receiving grooves 231. The second positioning portion 43' of the reverse receptacle module 200' is integrally formed at the side of the second locking plate 42' facing the second receptacles 3, and defines two second receiving grooves 431 which are respectively not left-right symmetrical relative to the second receptacles 3, and comprises a second spacer 432 positioned between the second receiving grooves 431, and positions of the second receiving grooves 431 relative to the second receptacles 3 offset toward the left and the right respectively with respect to positions of the first receiving grooves 231 relative to the first receptacles 1 so that the second spacer 432 is wider than the first spacer 232. The first casing 51' of the standard plug 5' further has a first housing 513', the third locking units 511 and the third positioning portion 512' are provided at a first outer side surface 5131' of the first housing 513'. And the third positioning portion 512' comprises four first protective blocks 5123, every two first protective blocks 5123 are respectively positioned on the left side and the right side of one third locking unit 511, so as to be correspondingly received in the one first receiving groove 231. And the two adjacent first protective blocks 5123 positioned in the middle together define a first receiving space 5124 to engage with and receive the first spacer 232. The second casing 61' of the reverse plug 6' further has a second housing 613'. The fourth locking units 611 and the fourth positioning portion 612' are provided at a second outer side surface 6131' of the second housing 613'. And the fourth positioning portion 612' comprises four second protective blocks 6123, every two second protective blocks 6123 are respectively positioned on the left side and the right side of one fourth locking unit 611, so as to be correspondingly received in the one second receiving groove 431, and widths of the two adjacent second protective blocks 6123 positioned in the middle are smaller than widths of the two second protective blocks 6123 positioned outside to together define a second receiving space 6124. The second receiving space 6124 is wider than the first receiving space 5124 to engage with and receive the second spacer 432. And the two second protective blocks 6123 positioned outside respectively extend outwardly toward the left and the right with respect to the two first protective blocks 5123 of the standard plug 5' positioned outside so as to correspond to that the second receiving grooves 431 respectively offset toward the left and the right. In this way, the third positioning portion 512' of the standard plug 5' is incompatible with the second positioning portion 43' of the second guide frame 4', when the user will insert the standard plug 5' into the reverse receptacle module 200', as the first receiving space 5124 of the standard plug 5' is narrow and cannot receive the second spacer 432 of the second positioning portion 43', so that the second spacer 432 is stopped, the third mating portion 52 of the standard plug 5' cannot mate with the second mating portion 31 of the reverse receptacle module 200'. Furthermore, the fourth positioning portion 612' of the reverse plug 6' is incompatible with the first positioning portion 23' of the first guide frame 2', when the user will insert the reverse plug 6' into the standard receptacle module 100', as the two second protective blocks 6123 of the reverse plug 6' positioned outside respectively extend outwardly toward the left and the right, the two second protective blocks 6123 of the reverse plug 6' positioned outside cannot enter into the first receiving grooves 231 of the first guide frame 2', the fourth mating portion 62 of the reverse plug 6' cannot mate with the first mating portion 11 of the standard receptacle module 100'. So it can be ensured that the standard plug 5' can only establish an electrical connection with the standard receptacle module 100', and the reverse plug 6' can only establish an electrical connection with the reverse receptacle module 200', incorrect insertion will not occur. The assembly relationships of other components of the third embodiment are substantially the same as those of the above first embodiment and second embodiment, and are not repeated herein.

It should be noted that, the third embodiment is described by the configuration of dual plug-receptacle, it can also be a configuration of quad plug-receptacle (two units) integrally provided side by side or a configuration of octa plug-receptacle (four units) integrally provided side by side, derived from the configuration disclosed by the third embodiment as one unit.

In conclusion, the latching components of the standard receptacle module 100, 100' and the standard plug 5, 5' and the reverse receptacle module 200, 200' and the reverse plug 6, 6' of the above embodiments all are positioned at the tops thereof respectively, so that the user can easily operate and avoid twisting of the cable 7, 7', the polarizing mechanism is further provided, so as to avoid incorrect insertion.

While a preferred embodiment of the Present Disclosure is shown and described, it is envisioned that those skilled in the art may devise various modifications without departing from the spirit and scope of the foregoing Description and the appended Claims.

What is claimed is:

1. An electrical connection device, the electrical connection device comprising:

a standard receptacle module, the standard receptacle module including:

a first receptacle, the first receptacle including a first mating portion, and a first guide frame, the first guide frame including a first frame body, a first locking plate and a first positioning portion, the first frame body being mounted to the first receptacle, the first locking plate extending from a side of the first frame body and being spaced apart from the first mating portion and having a first locking unit;

a reverse receptacle module, the reverse receptacle module including:

a second receptacle, the second receptacle including a second mating portion, and a second guide frame, the second guide frame including a second frame body, a second locking plate and a second positioning portion, the second frame body being mounted to the second receptacle, the second locking plate extending from a side of the second frame body and being spaced apart from the second mating portion and having a second locking unit; and a connector cable module, the connector cable module including:

a standard plug, the standard plug including a first casing and a third mating portion provided in the first casing and mating with the first mating portion, the first casing having a third locking unit engaging with the first locking unit and a third positioning portion compatible with the first positioning portion, a reverse plug, the reverse plug including a second casing and a fourth mating portion provided in the second casing and mating with the second mating portion, the second casing having a fourth locking unit engaging with the second locking unit and a fourth positioning portion compatible with the second positioning portion, and a cable, the cable connecting the standard plug and the reverse plug;

wherein the third positioning portion of the standard plug is incompatible with the second positioning portion of the second guide frame, and the fourth positioning portion of the reverse plug is incompatible with the first positioning portion of the first guide frame, so that the third mating portion of the standard plug cannot mate with the second mating portion of the reverse receptacle module, and the fourth mating portion of the reverse plug cannot mate with the first mating portion of the standard receptacle module with the standard plug configured to mate with the first receptacle and the reverse plug configured to mate with the second receptacle.

2. The electrical connection device of claim 1, wherein:

a positional relationship of the second receptacle relative to the second locking plate is equivalent to a positional relationship of the first receptacle after rotating 180° about an axis parallel to a mating direction relative to the first locking plate; and a positional relationship of the fourth mating portion of the reverse plug relative to the fourth locking unit is equivalent to a positional relationship of the third mating portion of the standard plug after rotating 180° about the axis parallel to the mating direction relative to the third locking unit.

3. The electrical connection device of claim 2, wherein:

the third mating portion includes a first sub-circuit board and a second sub-circuit board parallel and spaced apart from each other, and the fourth mating portion includes a first sub-circuit board and a second sub-circuit board as another group;

in the standard plug, the first sub-circuit board is positioned between the third locking unit and the second sub-circuit board, and first board surfaces of the first sub-circuit board and the second sub-circuit board face toward the third locking unit; and in the reverse plug, the second sub-circuit board is positioned between the fourth locking unit and the first sub-circuit board, and second board surfaces of the first sub-circuit board and the second sub-circuit board face toward the fourth locking unit.

4. The electrical connection device of claim 3, wherein:

the first receptacle is provided over a first circuit board and the first mating portion is positioned between the first locking plate and the first circuit board; and the second receptacle is provided under a second circuit board and the second locking plate and the second circuit board positioned at the same side of the second mating portion.

5. The electrical connection device of claim 4, wherein:

the first positioning portion of the standard receptacle module is integrally formed at a side of the first locking plate facing the first receptacle, and defines a first receiving groove which is left-right symmetrical relative to the first receptacle;

the second positioning portion of the reverse receptacle module is integrally formed at a side of the second locking plate facing the second receptacle, and defines a second receiving groove which is not left-right symmetrical relative to the second receptacle;

the first casing of the standard plug further has a first housing, the third locking unit and the third positioning portion are provided at a first outer side surface of the first housing, and the third positioning portion protrudes from the first outer side surface left-right symmetrically relative to the third locking unit so as to be received in the first receiving groove; and the second casing of the reverse plug further has a second housing, the fourth locking unit and the fourth positioning portion are provided at a second outer side surface of the second housing, and the fourth positioning portion protrudes from the second outer side surface not left-right symmetrically relative to the fourth locking unit so as to be received in the second receiving groove.

6. The electrical connection device of claim 5, wherein:

a position of the second receiving groove relative to the second receptacle offsets toward the left with respect to a position of the first receiving groove relative to the first receptacle;

the third positioning portion includes two first protective blocks which are positioned respectively on the left side and the right side of the third locking unit and are symmetrical; and the fourth positioning portion comprises two second protective blocks respectively positioned on the left side and the right side of the fourth locking unit, the second protective block positioned on the left side of the fourth positioning portion enlarges toward the left with respect to first protective block positioned on the left side of the third positioning portion, and the second protective block positioned on the right side of the fourth positioning portion reduces toward the left from a right edge with respect to the first protective block positioned on the right side of the third positioning portion, so as to correspond to that the second receiving groove offsets toward the left.

7. The electrical connection device of claim 5, wherein:

a position of the second receiving groove relative to the second receptacle offsets toward the right with respect to a position of the first receiving groove relative to the first receptacle;

the third positioning portion comprises two first protective blocks which are positioned respectively on the left side and the right side of the third locking unit and are symmetrical; and the fourth positioning portion comprises two second protective blocks respectively positioned on the left side and the right side of the fourth locking unit, and the second protective block positioned on the right side of the fourth positioning portion enlarges toward the right with respect to the first protective block positioned on the right side of the third positioning portion, and the second protective block positioned on the left side of the fourth positioning portion reduces toward the right from a left edge with respect to the first protective block positioned on the left side of the third positioning portion, so as to correspond to that the second receiving groove offsets toward the right.

8. An electrical connection device, the electrical connection device comprising:

a standard receptacle module, the standard receptacle module including:

two first receptacles, each first receptacle including a first mating portion, and a first guide frame, the first guide frame including a first frame body, a first locking plate and a first positioning portion, the first frame body being mounted to the first receptacles and making the first mating portions spaced apart from each other and provided side by side, the first locking plate extending from a side of the first frame body and being spaced apart from the first mating portions and having two first locking units respectively corresponding to the first mating portions;

a reverse receptacle module, the reverse receptacle module including:

two second receptacles, each second receptacle including a second mating portion, and a second guide frame, the second guide frame including a second frame body, a second locking plate and a second positioning portion, the second frame body being mounted to the second receptacles and making the second mating portions spaced apart from each other and provided side by side, the second locking plate extending from a side of the second frame body and being spaced apart from the second mating portions and having two second locking units respectively corresponding to the second mating portions; and a connector cable module, the connector cable module including:

a standard plug, the standard plug including a first casing and two third mating portions provided in the first casing and respectively mating with the first mating portions, the first casing having two third locking units respectively engaging with the first locking units and a third positioning portion compatible with the first positioning portion, a reverse plug, the reverse plug including a second casing and two fourth mating portions provided in the second casing and respectively mating with the second mating portions, the second casing having two fourth locking units respectively engaging with the second locking units and a fourth positioning portion compatible with the second positioning portion, and a cable physically connecting and electrically connecting the standard plug and the reverse plug;

wherein the third positioning portion of the standard plug is incompatible with the second positioning portion of the second guide frame, and the fourth positioning portion of the reverse plug is incompatible with the first positioning portion of the first guide frame, so that the third mating portion of the standard plug cannot mate with the second mating portion of the reverse receptacle module, and the fourth mating portion of the reverse plug cannot mate with the first mating portion of the standard receptacle module and the third mating portion of the standard plug mates with the first mating portion of the standard receptacle module and the fourth mating portion of the reverse plug mates with the second mating portion of the reverse receptacle module.

9. The electrical connection device of claim 8, wherein:

a positional relationship of the second receptacles relative to the second locking plate is equivalent to a positional relationship of the first receptacles after rotating 180° about the axis parallel to a mating direction relative to the first locking plate, respectively; and a positional relationship of the fourth mating portions of the reverse plug relative to the fourth locking unit is equivalent to a positional relationship of the third mating portions of the standard plug after rotating 180° about the axis parallel to the mating direction relative to the third locking units, respectively.

10. The electrical connection device of claim 9, wherein:

the third mating portions each include a first sub-circuit board and a second sub-circuit board which are parallel and spaced apart from each other, and the fourth mating portions each include a first sub-circuit board and a second sub-circuit board as another group;

in the standard plug, the first sub-circuit board of the each third mating portion is positioned between the corresponding third locking unit and the second sub-circuit board of the each third mating portion, and first board surfaces of the first sub-circuit board and the second sub-circuit board of the each third mating portion face toward the corresponding third locking unit; and in the reverse plug, the second sub-circuit board of the each fourth mating portion is positioned between the corresponding fourth locking unit and the first sub-circuit board of the each fourth mating portion, and second board surfaces of the first sub-circuit board and the second sub-circuit board of the each fourth mating portion face toward the corresponding fourth locking unit.

11. The electrical connection device of claim 10, wherein:

the first receptacles are provided over a first circuit board and the first mating portions are positioned between the first locking plate and the first circuit board; and the second receptacles are provided under a second circuit board and the second locking plate and the second circuit board positioned at the same side of the second mating portions.

12. The electrical connection device of claim 11, wherein:

the first positioning portion of the standard receptacle module is integrally formed at a side of the first locking plate facing the first receptacles, and defines two first receiving grooves which are respectively left-right symmetrical relative to the first receptacles and comprises a first spacer positioned between the first receiving grooves;

the second positioning portion of the reverse receptacle module is integrally formed at the side of the second locking plate facing the second receptacles, and defines two second receiving grooves which are respectively not left-right symmetrical relative to the second receptacles and comprises a second spacer positioned between the second receiving grooves, and positions of the second receiving grooves relative to the second receptacles offset toward the left and the right respectively with respect to positions of the first receiving grooves relative to the first receptacles so that the second spacer is wider than the first spacer;

the first casing of the standard plug further has a first housing, the third locking units and the third positioning portion are provided at a first outer side surface of the first housing, and the third positioning portion comprises four first protective blocks, every two first protective blocks are respectively positioned on the left side and the right side of one third locking unit, so as to be correspondingly received in the one first receiving groove, and the two adjacent first protective blocks positioned in the middle together define a first receiving space to engage with and receive the first spacer; and the second casing of the reverse plug further has a second housing, the fourth locking units and the fourth positioning portion are provided at a second outer side surface of the second housing, and the fourth positioning portion comprises four second protective blocks, every two second protective blocks are respectively positioned on the left side and the right side of one fourth locking unit, so as to be correspondingly received in the one second receiving groove, and widths of the two adjacent second protective blocks positioned in the middle are smaller than widths of the two second protective blocks positioned outside to together define a second receiving space, the second receiving space is wider than the first receiving space to engage with and receive the second spacer, and the two second protective blocks positioned outside respectively extend outwardly toward the left and the right with respect to the two first protective blocks of the standard plug positioned outside so as to correspond to that the second receiving grooves respectively offset toward the left and the right.

* * * * *